United States Patent [19]

Bourgraf et al.

[11] 4,037,871

[45] July 26, 1977

[54] MULTIPLE PURPOSE AMBULANCE COT WITH REMOVABLE STRETCHER TOP

[75] Inventors: Elroy E. Bourgraf, Cincinnati; Kenneth R. Self, Washington Court House, both of Ohio

[73] Assignee: Ferno-Washington, Inc., Wilmington, Ohio

[21] Appl. No.: 679,761

[22] Filed: Apr. 23, 1976

[51] Int. Cl.[2] ..... A61G 1/02

[52] U.S. Cl. ..... 296/20; 5/110

[58] Field of Search ..... 296/19, 20; 5/81 R, 5/110

[56] References Cited

U.S. PATENT DOCUMENTS

| | | | |
|---|---|---|---|
| 2,337,505 | 12/1943 | Swift | 296/20 |
| 2,456,024 | 12/1948 | Schofield | 296/19 |

*Primary Examiner*—Philip Goodman

*Attorney, Agent, or Firm*—Melville, Strasser, Foster & Hoffman

[57] ABSTRACT

An ambulance cot having a base structure which serve as a carrier for a removable stretcher forming a top for the carrier, the carrier base having frame members which form supporting tracks to receive flanged rollers mounted on the stretcher so that the stretcher may be rolled smoothly onto the carrier or removed therefrom, the carrier also mounting locking means for fixedly yet releasably securing the stretcher to the carrier.

7 Claims, 8 Drawing Figures

MULTIPLE PURPOSE AMBULANCE COT WITH REMOVABLE STRETCHER TOP

BACKGROUND OF THE INVENTION

The present invention relates to ambulance cots and more particularly to a multiple purpose ambulance cot having a base structure which serves as a carrier for a patient supporting stretcher which is detachably secured to the carrier so that the assembled unit may be employed as a conventional ambulance cot, the stretcher top being removable for separate use in instances where it would not be practical to use the entire cot.

The conventional ambulance cot is provided with wheels and is adapted to be secured to the floor and/or walls of the ambulance or emergency vehicle with which it is used, the vehicle being provided with special fittings to lock the cot in place. In addition to the standard ambulance cot in which the patient supporting cot frame is secured directly to an undercarriage having wheels at its corners, there are also elevating cots in which the patient supporting cot frame may be raised and lowered relative to the undercarriage, as well as arrangement wherein the cot frame is provided with legs mounting wheels at their lowermost ends, the legs being collapsible as the cot is placed in the vehicle. While such cot structures have a wide range of utility, situations are encountered wherein it is impractical to transport the patient to or from the ambulance utilizing any of the existing types of ambulance cots. For example, narrow passageways, tortuous turns, or steep stairways may make it impractical to use a conventional ambulance cot to transfer the patient. Many ambulances are equipped with separate pieces of equipment, such as stretches and stretcher-chairs to take care of such situations. However, this requires additional equipment as well as storage space for the additional equipment, and storage space is usually at a premium in most ambulances. In addition, since it is desirable to have both the patient and the cot securely fastened while traveling in the ambulance, it has hitherto been necessary to either transfer the patient to the existing ambulance cot, which can be securely fastened in place, or else strap the patient and the auxiliary stretcher to the existing cot frame, which is often difficult to do and requires additional handling time — time which can be critical in an emergency.

In contrast to the foregoing, the present invention provides an improved ambulance cot having a removable top or stretcher part which may be readily separated from the remainder of the cot for independent use, the arrangement being such that the stretcher top may be quickly and easily removed as well as reengaged with the cot.

SUMMARY OF THE INVENTION

In accordance with the invention, the ambulance cot comprises a base structure or carrier which may comprise any type of cot construction. That is, the base structure or carrier may comprise a standard undercarriage having wheels at its corners, or it may comprise an elevating type undercarriage, or it may have sets of collapsible legs with wheels at their lowermost ends. In short, the specific nature of the carrier base does not constitute a limitation on the invention other than to the extent it is provided with a stretcher supporting frame having a longitudinally extending pair of track-forming side rails. Preferably, the supporting frame will be formed from aluminum tubing provided with suitable cross bracing to provide a rigid support for the removable stretcher top. The stretcher top also may take different forms, although in essence it will comprise a rectangular frame, with or without cross bracing, having a patient supporting fabric bottom or mattress.

In accordance with the preferred embodiment of the invention, the stretcher frame is provided toward its opposite ends with sets of flanged rollers adapted to seat on the track forming side rails of the underlying supporting frame. Thus, if the base structure of the cot is secured in place in the ambulance, the stretcher top may be readily removed from the ambulance by rolling it rearwardly along the side rails of the cot frame, and similarly the stretcher may be replaced by rolling it forwardly along the side rails. Means are provided to securely yet releasably fasten the stretcher top to the carrier base. To this end, a stretcher engaging clamping member is provided at the leading end of the cot frame which engages about the leading end of the stretcher, the clamping member being positioned so that when it is engaged by the leading end of the stretcher, the adjacent pair of flanged rollers on the stretcher will be maintained in tight engagement with the track-forming side rails of the supporting frame. Toward its trailing end, the supporting frame mounts locking means comprising a spring-biased latch member having a hook-like recess which engages about a crossbar extending between the opposite sides of the stretcher top. The latch member is spring-biased to the closed or locked position and is provided with a rearwardly extending latch arm having a handle portion adjacent the trailing end of the cot frame by means of which the attendant may readily disengage the latch member. In addition, the latch member is provided with cam surfaces which deflect the latch member when contacted by the crossbar on the stretcher to permit the crossbar to pass beyond the deflected latch member, whereupon its hook-like recess engages the crossbar, which occurs as the leading end of the stretcher seats beneath the clamping member at the leading end of the supporting frame. Thereafter, the stretcher can be released from the carrier only by positive movement of the rearwardly extending latch arm under the control of the attendant.

DESCRIPTION OF THE PREFERRED EMBODIMENT

Figure 1:
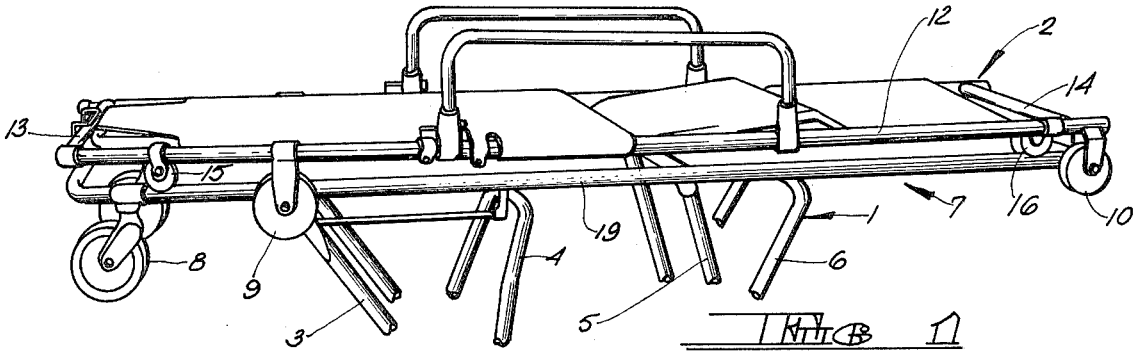
FIG. 1 is a perspective view of an exemplary cot construction in accordance with the invention.

Referring first to FIG. 1, which illustrates an exemplary cot construction in accordance with the invention, the carrier base, indicated generally at 1, underlies and supports the detachable stretcher top, indicated generally at 2. In the illustrated embodiment, the carrier base comprises a roll-on type of cot having sets of collapsible legs 3, 4, 5 and 6, of known construction, which support suitable caster wheels (not shown) at their lowermost ends. The sets of legs are pivotally connected to a supporting frame 7 which, in the case of a roll-on type of cot, may include caster wheels 8 by means of which the cot is rolled into the ambulance, the carrier base is locked in place by suitable fittings permanently mounted in the ambulance, as will be understood by the worker in the art. It is to be understood, however, that the specific nature of the carrier base does not constitute a limitation on the invention; and the base may take different forms, inclusive of a standard rectangular undercarriage to which the supporting frame 7 is fixedly secured, and elevating cots wherein adjustable or scissors-like leg members extend between an undercarriage and the supporting frame 7. It also will be understood that the carrier base may include various additional attachments and operating mechanisms for locking and unlocking the collapsible legs, or for raising and lowering the supporting frame relative to the undercarriage, all of which are known to the art and which have been eliminated from the drawings for simplicity in illustrating the invention, which is concerned primarily with the interface between the supporting frame 7 of the carrier base and the overlying stretcher top 2.

Similarly, the stretcher top may take various forms. In the embodiment illustrated, it comprises a so-called stretcher-chair, which is a versatile form of stretcher capable of being readily converted from a straight stretcher to a stair or wheel chair, the stretcher including sets of wheels 9 and 10. However, the stretcher top may take different forms ranging from a simple straight stretcher having a rectangular frame covered with a suitable fabric to more sophisticated adjustable structures, such as the aforementioned stretcher-chair, the essential component of the stretcher top being a frame capable of mounting sets of flanged rollers to form an interface with the underlying supporting frame of the carrier base.

Figure 2:
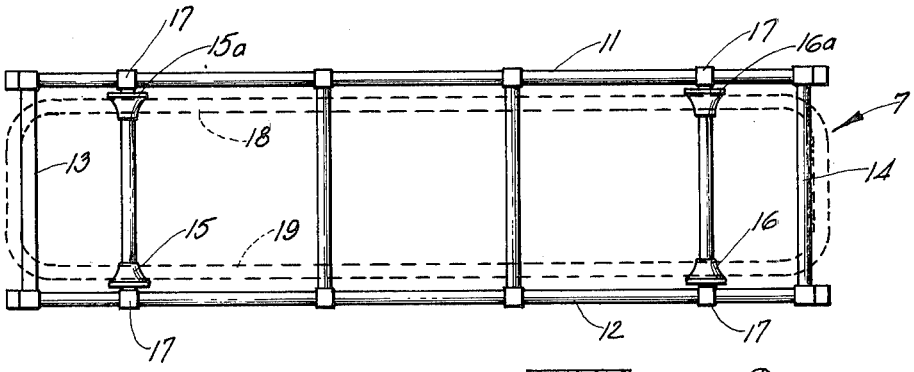
FIG. 2 is a plan view of a basic stretcher frame showing its relationship to the underlying supporting frame forming a part of the carrier base.

In accordance with the invention, and with reference to FIG. 2, the stretcher top comprises a basic frame having longitudinally extending side rails 11 and 12, and leading and trailing end rails 13 and 14, respectively, which are preferably formed from aluminum tubing. The basic frame may be of unitary construction or it may be composed of articulated sections depending upon the nature of the stretcher. An essential feature is the provision of sets of flanged rollers 15, **15*a* and 16, 16*a* mounted on brackets 17 secured to side rails 11 and 12, the rollers underlying the plane of the stretcher frame and being positioned to seat on the longitudinally extending side rails 18 and 19 of the underlying supporting frame 7**. With this arrangement, the stretcher top may be rolled lengthwise along the side rails of the supporting frame or it may be placed directly on top of the supporting frame; in either event, the flanged rollers position the frames relative to each other and secure them against relative lateral movement. While the rollers illustrated have flanges on their outer sides only, it will be evident that both sides of the rollers may be flanged to engage about the underlying side rails, which are preferably of cylindrical configuration.

Figure 3:
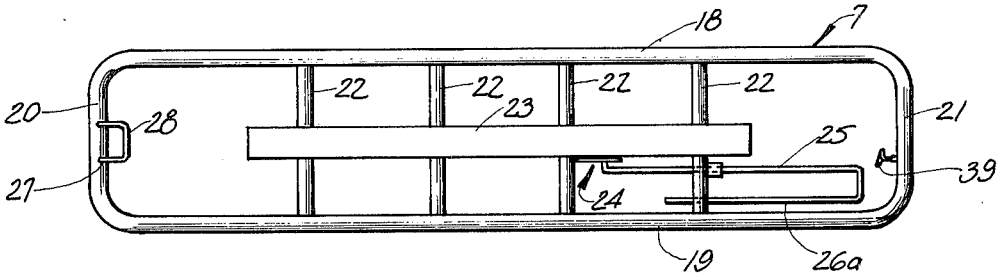
FIG. 3 is a plan view of an exemplary supporting frame incorporating stretcher locking means.

As seen in FIG. 3, the side rails 18 and 19 of the supporting frame may have their ends curved inwardly and secured together to form leading and trailing end rails 20 and 21. Preferably, the side rails 18 and 19 will be free from obstructions, such as brackets, mounting collars, and the like, so that the rollers may move freely along the side rails. In the exemplary embodiment illustrated, the supporting frame is provided with a plurality of cross braces 22 which support a centrally disposed longitudinally extending brace 23, which may be of "I" shape in cross-section.

Figure 4:
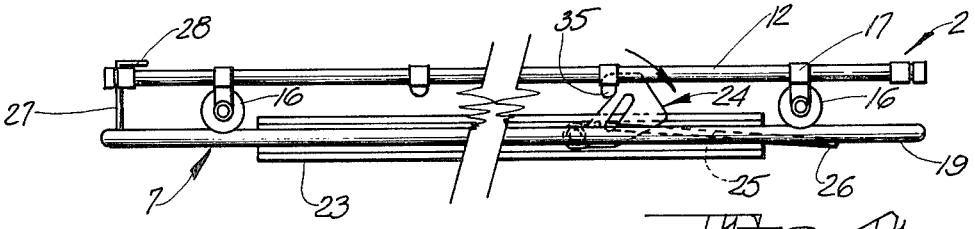
FIG. 4 is the side elevational view illustrating the manner in which the stretcher frame seats on the underlying supporting frame.

The brace 23 mounts a locking means, indicated generally at 24, controlled by a rearwardly extending latch arm 2 having a handle forming portion or bail 26 at its remote end. The end rail 13 at the leading end of the supporting frame mounts a clamping bracket 27 having an angularly related bail 28 positioned to overlie and engage the leading end rail 13 of the stretcher, as will be evident from FIG. 4. The bracket 27 serves as a stop for the leading end of the stretcher top as it is positioned on the supporting frame, and the position of the bail 28 is such that it serves to hold the set of rollers 15 and **15*a* in firm engagement with the underlying side rails 18 and 19** of the supporting structure.

Figure 5:
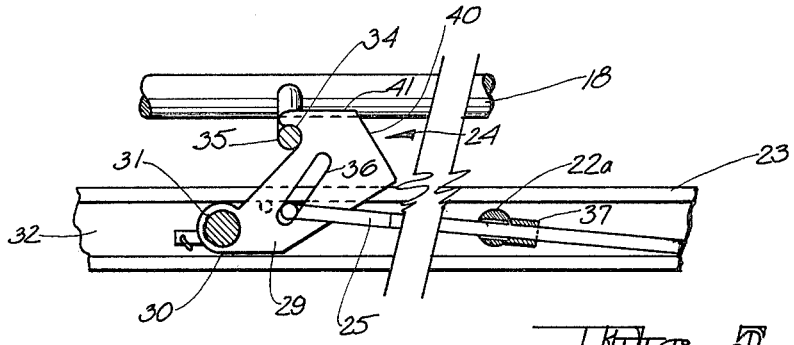
FIG. 5 is an enlarged fragmentary vertical sectional view illustrating the locking means in the locked position.

Referring next to FIG. 5, the locking means 24 comprises a latch member 29 having a hub 30 rotatably journaled on a stub shaft 31 secured to the vertical portion 32 of brace 23. A spring member 33 biases the latch member 29 to the normally closed position shown in FIG. 5, the latch having a hook-like recess 34 which engages a cross brace 35 forming a part of the stretcher top. As will be evident from FIG. 4, when the latch is in the locked position and in engagement will cross brace 35, it coacts with the clamping bracket 27 to hold the stretcher top against longitudinal movement in either direction relative to the supporting frame 7.

Figure 6:
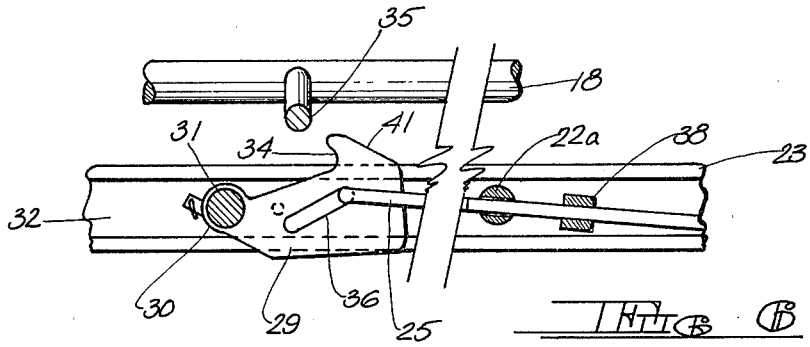
FIG. 6 is a vertical sectional view similar to FIG. 5 illustrating the locking means in the open position.
Figure 7:
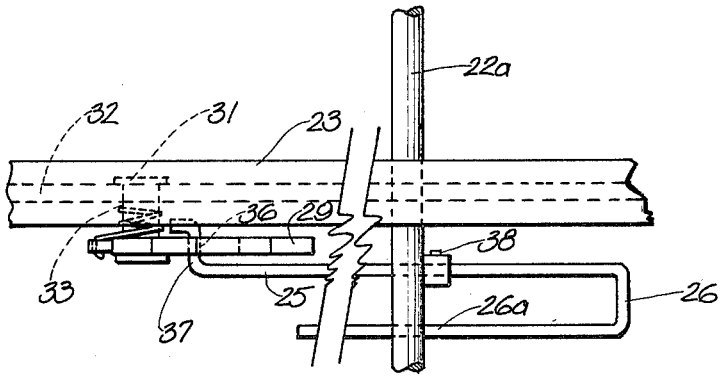
FIG. 7 is an enlarged fragmentary plan view of the locking means.

Referring again to FIG. 5, the latch member 29 has an angularly disposed elongated slot 36 engaged by the forward end of latch arm 25, the latch arm having an angularly related finger 37, seen in FIG. 7, which extends freely through the slot 36. When the latch arm 25 is moved rearwardly, the latch member will be rocked in a clockwise direction against the tension of spring 33, the finger 37 of the latch arm traveling lengthwise along the slot 36 until the parts assume the position illustrated in FIG. 6 in which the cross brace 35 is released and the hook-like recess in the latch member lies beneath the path of travel of the cross brace 35, the stretcher top thereby being released for removal from the supporting frame of the base carrier. In the embodiment illustrated, the latch arm 25 is slidably journaled in cross brace **22*a* of the supporting frame which provides a support for the latch arm; and the latch arm may be provided with a stop 38 adapted to abut against the cross brace 22*a* when the latch member is in the locked position. Similarly, the return portion 26*a* of the handle forming bail 26 also may be slidably journaled in cross brace 22*a*, thereby stabilizing the latch arm and handle. It will be understood that the handle will be positioned adjacent the trailing end 21 of the supporting frame so that it is readily accessible to the attendant, and a rotatable bail engaging hook 39 may be provided on the trailing end frame member 21** so that the attendant may secure the latch member in the released position.

Figure 8:
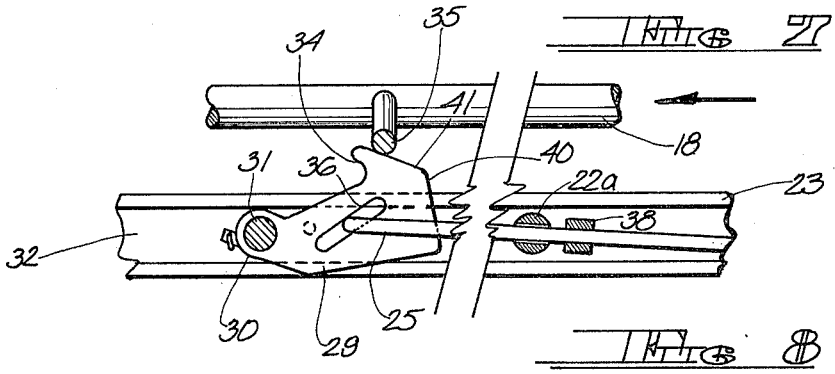
FIG. 8 is a fragmentary vertical sectional view similar to FIG. 6 illustrating the manner in which the crossbar on the stretcher frame cams the locking means to the open position as the stretcher frame is rolled along the supporting frame.

The latch member 29 is also provided with a pair of angularly related cam surfaces 40 and 41 which coact with the cross brace 35, as well as any other cross braces or end rails forming a part of the stretcher top, to automatically deflect the latch member downwardly as the stretcher top is rolled along the supporting frame toward the leading end thereof. As will be evident by comparing FIGS. 5 and 8, as a cross member, such as the cross brace 35, approaches the latch member 29, it will first contact the cam surface 40 and deflect the latch member downwardly, the latch member pivoting about the stub shaft 31 against the compression of spring 33. As the advancing movement of the cross brace 35 continues, it will ride onto the angularly related cam surface 41, thereby continuing the downward movement of the latch member until the cross brace passes beyond the end of cam surface 41, whereupon the latch member will be freed for return to its upstanding or locked position in which the hook-like recess engages about and grips the cross brace 35.

As should now be evident, the instant invention provides a versatile ambulance cot which, in a single unit, is capable of performing additional functions normally requiring two or more separate and distinct pieces of equipment. When the carrier base and stretcher top are locked together, the unit functions as a conventional ambulance cot and, as previously indicated, the carrier base may take various forms, as may the stretcher top, thereby providing a wide range of versatility depending upon the functions to be performed by the unit.

Modifications may be made in the invention without departing from its spirit and purpose. Numerous such modifications have already been set forth and others will undoubtedly occur to the worker in the art upon reading this specification. For example, while in the preferred embodiment illustrated the flanged rollers are mounted on the stretcher top and positioned for contact with the side rails of the underlying supporting frame, the parts can be reversed and the flanged rollers mounted on the supporting frame in positions to be contacted by the side rails of the stretcher frame. While flanged rollers are preferred, the rollers can be of cylindrical configuration with the side rails of the supporting frame shaped to receive and guide the rollers. Accordingly, it is not intended that the spirit and scope of the invention be limited other than in the manner set forth in the claims which follow.

The embodiments of the invention in which an exclusive property or privilege is claimed are defined as follows:

1. A multiple purpose portable ambulance cot comprising a carrier base and a detachable stretcher top, said carrier base having a supporting frame including a pair of side rails, said stretcher top having a stretcher frame including a pair of side rails, sets of rollers mounted on one of said frames for engagement with the side rails of the other frame, and releasable locking means for detachably securing said stretcher top to the supporting frame of said carrier base with said rollers in engagement with said rails, whereby said stretcher top forms the patient receiving portion of the cot when attached to the carrier base, the stretcher top being removable for separate use.

2. The cot structure claimed in claim 1 where said sets of rollers are flanged and adapted to seat on the side rails of said supporting frame, and wherein the side rails are tubular.

3. The cot structure claimed in claim 1 wherein said releasable locking means is positioned to detachably secure said stretcher top to said supporting frame toward the trailing ends thereof, and wherein said supporting frame and said stretcher top each has a leading and a trailing end, and clamping means for detachably securing the leading end of said stretcher top to the leading end of said supporting frame.

4. The cot structure claimed in claim 3 wherein said releasable locking means comprises a latch member pivotally connected to said supporting frame, said latch member having a locked position and a release position, a latch receiving member on said stretcher top positioned to be engaged by said latch member in the locked position, and means for moving said latch member from one position to the other.

5. The cot structure claimed in claim 4 including spring means normally biasing said latch member to the locked position.

6. The cot structure claimed in claim 5 wherein said latch member has a cam surface positioned to be contacted by said latch receiving member to move said latch to its released position as said stretcher top is rolled along said supporting structure toward the leading end thereof.

7. The cot structure claimed in claim 6 wherein the means for moving said latch member from one position to the other comprises a latch arm operatively connected at one end to said latch member and projecting toward the trailing end of said supporting frame, said latch arm having a handle forming bail at its opposite end.

* * * * *